United States Patent [19]

Higaya et al.

[11] Patent Number: 4,640,608

[45] Date of Patent: Feb. 3, 1987

[54] CLEANING METHOD FOR USE IN ELECTROPHOTOGRAPHY

[75] Inventors: Toshiaki Higaya; Masaaki Ogura, both of Kanagawa; Takato Yano, Saitama; Kiyozo Hashizume, Tokyo; Toshiyuki Ogawa; Nachio Seko, both of Kanagawa, all of Japan

[73] Assignee: Ricoh Co., Ltd., Japan

[21] Appl. No.: 250,929

[22] Filed: Apr. 6, 1981

Related U.S. Application Data

[63] Continuation of Ser. No. 31,415, Apr. 19, 1979, abandoned.

[30] Foreign Application Priority Data

May 11, 1978 [JP] Japan ..... 53-55957

[51] Int. Cl.[4] ..... G03G 21/00

[52] U.S. Cl. ..... 355/15; 15/256.51; 430/125

[58] Field of Search ..... 355/3 R, 15; 430/125; 15/256.51, 256.52

[56] References Cited

U.S. PATENT DOCUMENTS

| | | | |
|---|---|---|---|
| 4,127,083 | 11/1978 | Sesoko | 355/15 X |
| 4,131,359 | 12/1978 | Honda | 355/15 |
| 4,158,498 | 6/1979 | Ohmori | 355/15 |
| 4,174,172 | 11/1979 | Lane | 355/15 |
| 4,205,911 | 6/1980 | Dole | 355/15 |

*Primary Examiner*—Fred L. Braun

*Attorney, Agent, or Firm*—Wyatt, Gerber Shoup, Scobey and Badie

[57] ABSTRACT

The cleaning method for use in an electrophotographic copying apparatus of the type removing toner images remaining on the surface of a photoconductor by a cleaning blade which includes the steps of bringing the cleaning blade into pressure contact with the photoconductor at least prior to the movement of the photoconductor, and moving the cleaning blade away from the surface of the photoconductor after the movement of the photoconductor is stopped with completion of copying process.

2 Claims, 5 Drawing Figures

CLEANING METHOD FOR USE IN ELECTROPHOTOGRAPHY

This application is a continuation of our copending application Ser. No. 031,415 filed Apr. 19, 1979 and now abandoned.

BACKGROUND OF THE INVENTION

The present invention relates to a cleaning method for use in an electrophotographic copying machine, and more particularly to a cleaning method for removing toner images remaining on a photoconductor by use of a cleaning blade.

Conventionally, as a cleaning method in general use for an electrophotographic copying machine, a fur brush cleaning method is known. In this method, since toner particles removed from the photoconductor by a fur brush are collected in a filter bag by a vacuum suction apparatus, this method has shortcomings, such as the cleaning apparatus becoming oversized, and the vacuum suction apparatus making loud noises, and it being difficult to reuse the toner recovered in the filter bag. Furthermore, there are known a magnetic brush cleaning method and a roller cleaning method. In the case of the magnetic brush cleaning method, the cleaning effect is inferior to the other cleaning methods. Accordingly, the magnetic brush cleaning method is not useful, except in a special process. To be more specific, in the case of the magnetic brush cleaning method, as the toner concentration in the magnetic brush increases during continuous cleaning, the cleaning effect is gradually reduced. Accordingly, some special apparatus for removing only the toner from said magnetic brush is necessary. On the other hand, in the case of the roller cleaning method, it has a cleaning effect similar to that of the blade cleaning method. However, the main cleaning effect of the roller cleaning method is attained by trapping toner in the numerous pores in the surface of the roller. Therefore, when the pores have been filled with toner, the cleaning effect is extremely reduced. In order to prevent this, a scraper is brought into pressure contact with the surface of the roller to remove toner from the pores and to reuse the roller for cleaning. However, since the scraper is in pressure contact with the surface of the roller, the surface of the roller is abraded so that the diameter of the roller is changed significantly or the useful life of the roller is shortened or a complicated pressure application mechanism is required.

The present invention relates to a blade cleaning method with a high cleaning efficiency. Conventionally, in this sort of the blade cleaning method, a cleaning blade is normally in pressure contact with the surface of a photoconductor. However, such a system is inconvenient for replacing a photoconductor drum, and furthermore, since unnecessary pressure is applied to the surface of the photoconductor drum, it becomes a problem that the surface of the photoconductor drum is changed physically or chemically while in use. Therefore, in a more recent apparatus, the cleaning blade is brought into contact with and moved away from the surface of the photoconductor drum or the surface of a photoconductor belt in synchronism with a drive motor for driving the photoconductor drum or belt. Alternatively, the pressure of the cleaning blade is released when an image formation portion passes over a cleaning station after copying.

However, the system of synchronizing the contacting and separating movement of the cleaning blade with the actuation of the drive motor has the following shortcomings: Even if the cleaning blade is moved away from the surface of the photoconductor drum by releasing the pressure of the cleaning blade as soon as the drive motor is stopped, the photoconductor drum is moved slightly by its inertia after the drive motor has been stopped. Since there always exist toner particles in the contact portion between the end portion of the cleaning blade and the photoconductor drum, when the cleaning blade is moved away from the photoconductor drum 1, the photoconductor drum 1, with part or all of the toner particles thereon, passes over the cleaning station as shown in FIG. 1. Furthermore, the portion of the photoconductor drum 1 moved by ther inertia thereof is uncleaned, which is indicated by N1 in FIG. 1. Accordingly, the next copying cannot be started immediately. This is because when a latent electrostatic image is formed on the photoconductor drum 1 with toner remaining thereon, the obtained copy quality is poor. Likewise, when a print button is depressed, the photoconductor drum 1 is moved before the cleaning blade 2 is brought into pressure contact with the photoconductor drum 1, because it takes time to bring the cleaning blade 2 into contact with the photoconductor drum 1 since the cleaning blade 2 is positioned away from the drum 1.

Therefore, as shown in FIG. 2, there is formed an additional uncleaned portion N2. Images cannot be formed in these uncleaned portions N1 and N2.

Furthermore, in the case where the photoconductor drum 1 is driven with a lump of toner particles T thereon as shown in FIG. 1 and the lump of toner particles T comes to a position where it can be dropped under its own weight, the lump of toner particles is separated from the photoconductor drum 1 and is scattered in the copying machine, smearing the inside of the copying machine and bringing about significant lowering of the performance of the copying process. In a cleaning blade system capable of moving the cleaning blade away from the photoconductor drum 1 after the latter image formation portion N2 has passed through the cleaning station, the above-mentioned disadvantages still occur.

SUMMARY OF THE INVENTION

It is therefore an object of the present invention to provide a novel cleaning method capable of cleaning the whole surface of a photoconductor securely and preventing the toner cleaned off the photoconductor from scattering from the cleaning station and eliminating the above-mentioned shortcomings of the conventional cleaning method; whereby the next copying can be performed immediately after each cleaning step.

In a cleaning method of the present invention, a cleaning blade is brought into pressure contact with a photoconductor at least before the photoconductor is moved, and the cleaning blade is moved away from the surface of the photoconductor when the photoconductor is stopped after completion of each copying process.

According to the present invention, since an uncleaned portion does not exist at all on the surface of the photoconductor, copying can be started immediately after a print button is depressed for initiating the next copying process. Furthermore, since no toner is scattered from the cleaning station, a problem of smearing by toner is not caused, so that high quality image can be surely obtained. Furthermore, when copying is not made, the cleaning blade is detracted from the surface of the photoconductor and accordingly, no substantial pressure is applied to the photoconductor, so that the physical and chemical changes of the photoconductor are not caused. Since cleaning blade is positioned slightly away from the surface of the photoconductor when copying is not made, toner particles are not scattered from between the end portion of the cleaning blade and the surface of the photoconductor, and the time from pressure application command to actual pressure applicaction can be extremely shortened, so that the copying efficiency can be advantageously increased.

DETAILED DESCRIPTION OF THE PREFERRED EMBODIMENT

Figure 3:
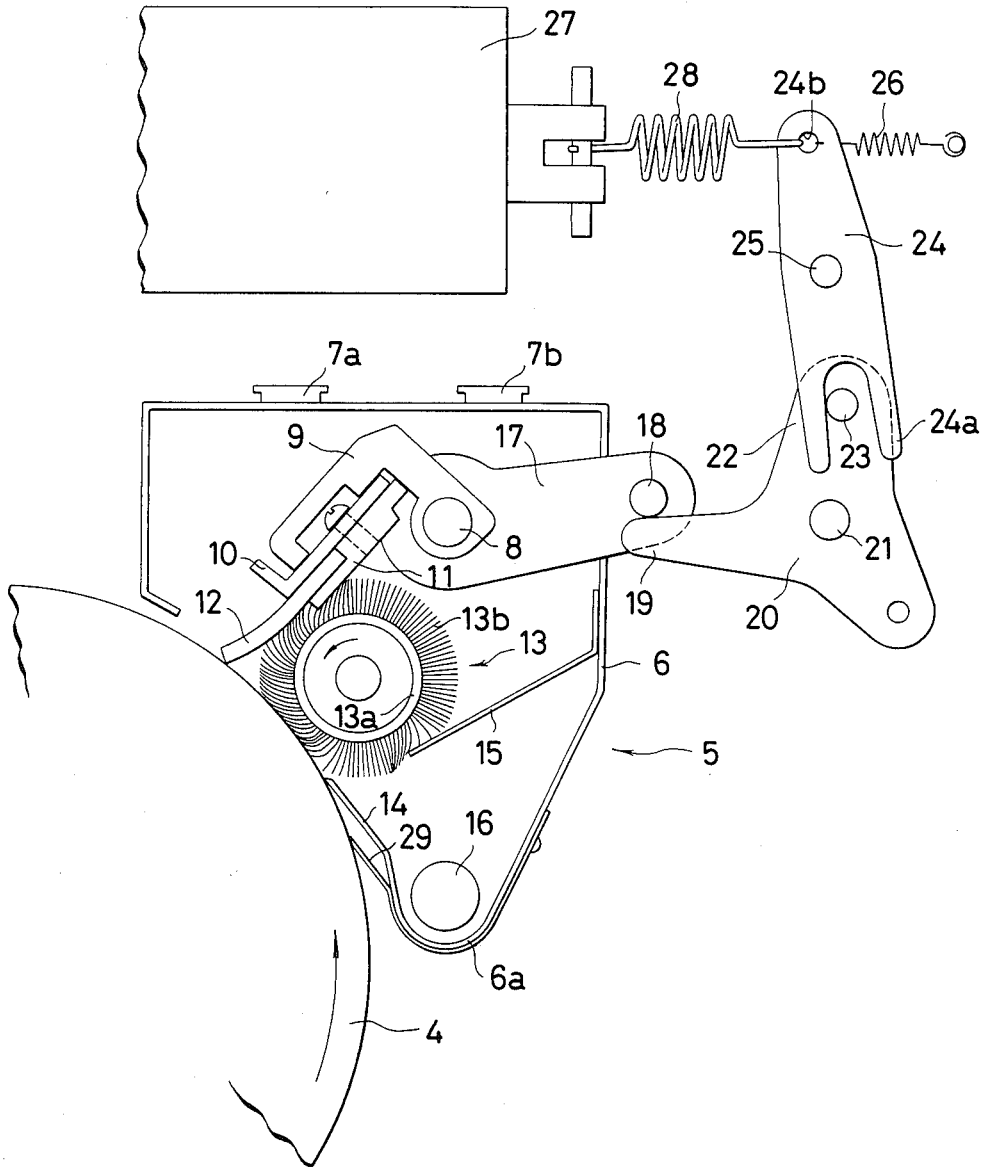
FIG. 3 is a schematic sectional view of an embodiment of a cleaning apparatus according to the present invention.

Referring to FIG. 3, there is shown a schematic sectional view of an embodiment of a cleaning method according to the present invention. In FIG. 3, numeral 4 represents a photoconductor drum, which is rotated in the direction of the arrow by a drive motor (not shown). As the photoconductor for use in the present invention, a three-layer type photoconductor having a transparent insulating layer thereon can be used as well as a selenium base photoconductor. What is necessary with respect to the photoconductor for use in the present invention is that it has a physical property that the surface thereof is strong enough for abrasion since a blade cleaning system is employed. As a matter of course, instead of the photoconductor drum 4, a belt-shaped photoconductor can be employed as well in the present invention. Above the photoconductor drum 4, there is situated a cleaning apparatus 5. A casing 6 of the cleaning apparatus 5 can be withdrawn from the body of this copying machine along guide rails 7*a* and 7*b* disposed in an upper portion of the casing 6 and a guide member (not shown) attached to the body of the copying machine. Inside the casing 6, there are disposed a shaft 8 which is attached between the side plates of the casing 6, a blade holder 9 disposed rotatably on the shaft 8, two clamp members 10 and 11 attached to the blade holder 9, a cleaning blade 12 which is detachably held between the clamp members 10 and 11, a brush roller 13 which is rotated in the direction of the arrow, a seal member 14, a flicker bar 15, and a toner transportation coil 16. The base portion of the cleaning blade 12 is held between the two clamp members 10, 11, which serve to reinforce the cleaning blade 12. The cleaning blade 12 is made of a resilient material which does not scratch the photoconductor, such as polyurethane rubber. The clamp members 10, 11 are fixed to the blade holder 9 by screws or the like. When the cleaning blade 12 is abraded, it can be replaced with a new one in a cartridge by loosening the screws. The cleaning blade 12 is disposed so that its top edge is directed in the same direction as the rotating direction of the photoconductor drum 4 and the cleaning blade 12 can be released in the radial direction of the photoconductor drum 4. In one end portion of the casing 6, a seal member 14 is formed, which permits the uncleaned toner on the photoconductor drum 4 to pass therethrough, but does not permit the toner removed by the cleaning blade 12 to pass therethrough. The seal member 14 is slightly wider than the cleaning blade 12 and its free end extends in the advancing direction of the peripheral surface of the photoconductor 4. In the seal member 14 of the present embodiment, nylon threads are embedded in the surface of an aluminum evaporated polyester film. Between the cleaning blade 12 and the seal member 14, there is disposed the brush roller 13 comprising a rotating cylinder 13*a*, which is rotated counterclockwise at a lower speed than that of the photoconductor drum 4, and a brush 13*b* with long bristles embedded in the peripheral surface of the rotating cylinder 13*a*. As the brush roller 13, a fur brush and a fiber brush can be employed so long as it does not scratch the surface of the photoconductor drum 4. The brush roller 13 serves to wipe or transport foreceably downwards the toner removed from the surface of the photoconductor drum 4 by the cleaning blade 12 and to remove continuously the toner accumulated on the top portion of the seal member 14 by the brush 13*b*. On the right side of the brush roller 13 in FIG. 3, there is disposed the flicker bar 15, and one end of the flicker bar 15, and one end of the flicker bar 15 is attached to the casing 6 and the other end of which engages with the brush 13*b* of the brush roller 13. The flicker bar extends in the axial direction of the brush roller so as to cover the brush roller 13. In the lower portion of the casing 6, there is formed a concave portion 6*a* for collecting therein toner transported by the brush roller 13, and inside the concave portion 6*a*, there is disposed rotatably the toner transportation coil 16, which is a helical coil and is driven by a drive means (not shown).

A lever 17 is fixed to the shaft 8 on which the blade holder 9 is supported. To one end portion of the lever 17, there is fixed a pin 18. A first link 20 having an arm 19 which can be engaged with the pin 18 is disposed so as to be rotatable on a shaft 21. To another arm 22 of the first link 20, there is disposed a pin 23, which is fitted in a U-shaped notch 24*a* formed in one end portion of a second link 24. To the other end portion of the second link 24, there are respectively fixed through a hole 24*b* a spring 26 urged to rotate the second link 24 clockwise about a shaft 25, and a spring 28 stretched between the second link 24 and a solenoid 27. A 50 μm thick polyester film 29 is attached to a lower portion of the casing 6 in order to receive toner thereon when toner falls down from the seal member 14.

The operation of the present cleaning apparatus will now be explained.

Figure 1:
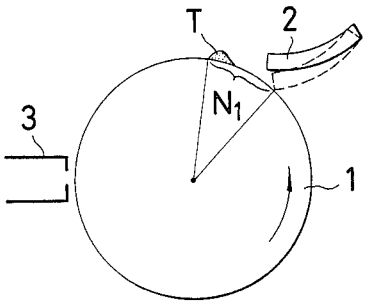
PRIOR ART FIG. 1
FIGS. 1 and 2 are diagrammatic illustrations of a conventional cleaning method.
Figure 2:
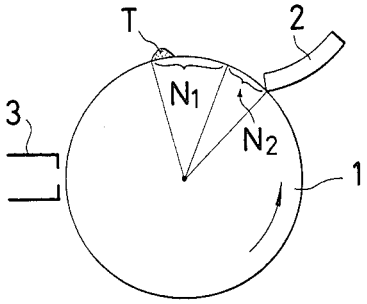
PRIOR ART FIG. 2
Figure 4:
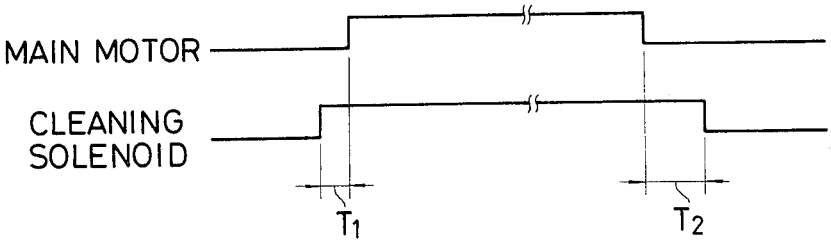
FIG. 4 is the timing chart of a main motor and of a cleaning solenoid for use in the present invention.
Figure 5:
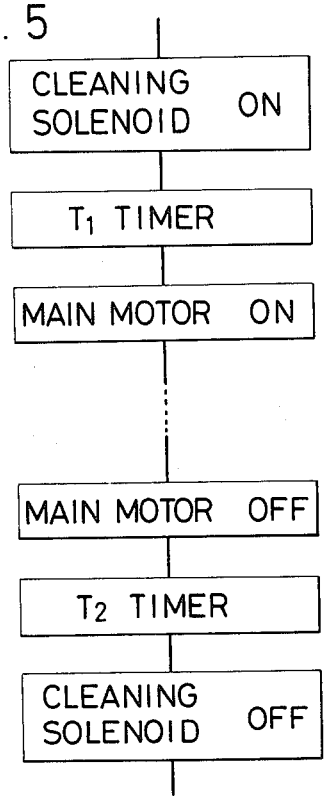
FIG. 5 is a partial flow chart of the cleaning operation in the embodiment according to the invention.

When the power supply is put to work to actuate the copying machine, current flows through an toner fixing apparatus and the other apparatuses of the copying machine, so that the copying machine is set in a preparatory condition for copying. When the copying machine has been set ready for copying, a display apparatus is turned on to indicate the copying ready condition. When a print button is then depressed, the solenoid 27 for cleaning is energized as shown in the diagrams of FIGS. 4 and 5. When the solenoid 27 is energized, a plunger and the spring are pulled to the left side by the solenoid 27 and accordingly, the second link 24 is rotated counterclockwise about the shaft 25 against the bias of the spring 26, so that the pin 23 fitted in the notch 24*a* is moved to the right side and the first link 20 is rotated clockwise on the shaft 21. On the other hand, the arm 19 is moved upwards and is engaged with the pin 18 of the lever 17, so that the lever 17 is rotated counterclockwise about the shaft 8. Accordingly, the blade holder 9 which is integral with the shaft 8 is also rotated in the same direction, whereby the cleaning blade 12 is brought into pressure contact with the photoconductor drum 4. In the case where an abnormal force happens to be applied to the cleaning blade 12 even during the pressure application and the cleaning blade 12 is moved away from the surface of the photoconductor drum 4, such an abnormal force is absorbed by the spring 28. In $T_1$ second after command for energizing the solenoid 27, for example, in 0.3 second, a main motor or a drive motor for driving the photoconductor drum 4 is actuated. Therefore, there is no portion where a lump of toner particles has passed under the cleaning blade 12, namely, there is no uncleaned portion on the photoconductor drum 4. A latent electrostatic image is formed on the surface of the photoconductor drum 4 and the latent electrostatic image is developed by a two-component type developer comprising toner and carriers or by a one-component type developer consisting of non-magnetic or magnetic toner, and the thus developed toner image is transferred to a transfer paper by an image transfer apparatus (not shown). After image transfer, the transfer paper is separated from the photoconductor drum 4 and the toner image is fixed permanently to the transfer paper by an toner fixing apparatus and is then discharged from the copying machine. In the meantime, after image transfer, some untransferred toner particles remain on the photoconductor drum 4, but they are cleaned off by the cleaning apparatus 5. When the cleaning blade 12 is used for a long time, it is abraded and cannot be used any longer. Therefore, by counting the number of use of the cleaning blade 12 or the operation time thereof, the whole of the cleaning apparatus 5 is pulled out to the front side along the guide rails 7*a* and 7*b*, so that the cleaning blade 12 or the brush roller 13 is replaced with a new cleaning blade or a new brush roller. This can be done easily in the present invention. In the case of continuous copying, when a final copying is finished, and in the case of single copying, when the single copying is finished (namely, when the cleaning operation is finished), the drive of the main motor is initialy disconnected, but the main motor continuously rotates for a short time by its inertia and then stops completely. This continuous rotation time is within 2.5 seconds. Therefore, in $T_2$ seconds after command of deenergizing the main motor or the drive motor, for instance, in 2.5 seconds, the solenoid 27 is deenergized. In other words, after the rotation of the photoconductor drum 4 is stopped, the cleaning blade 12 is moved away from the photoconductor drum 4. Since each setting time of $T_1$ and $T_2$ is different from one copying machine to the other, they are set appropriately. They can be set by a known timer circuit apparatus. When the solenoid 27 is deenergized, the second link 24 is rotated clockwise about the shaft 25 under the bias of the spring 26, and the first link 20 is rotated clockwise about the shaft 21, so that the lever 17 is rotated clockwise about the shaft 8, whereby the cleaning blade 12 is moved away from the surface of the photoconductor drum 4. The clearance between the cleaning blade 12 and the photoconductor drum 4 is within 1mm, preferably in the range of 0.1 mm to 0.5 mm. In order to set this clearance securely, it is preferable to dispose a bias means, such as a spring, giving a bias to the lever 17 so as to rotate the lever 17 clockwise about the shaft 8, and to dispose a stopper member which engages with the lever 17. When the photoconductor drum 4 is attached or detached, the stopper member is retracted and the cleaning blade 12 is moved far away from the photoconductor drum 4, so that the photoconductor drum 4 can be easily attached or detached. The reasons why the cleaning blade 12 is set with a slight clearance from the photoconductor drum 4 are as follows: Firstly, the small clearance can prevent toner from scattering from between the cleaning blade 12 and the photoconductor drum 4. Secondly, when the cleaning blade 12 is brought into pressure contact with the photoconductor drum 4, the time for bringing the cleaning blade 12 into pressure contact with the photoconductor drum 4 can be advantageously reduced. Thirdly, in the material for the cleaning blade 12, a binder agent is used, which prevents the characteristics of the photoconductor drum 4 from changing while the cleaning blade 12 is in contact with the photocnductor drum 4 for a long period of time.

In the above-mentioned embodiment, the top portion of the cleaning blade 12 is directed in the same direction as that of the movement of the photoconductor drum 4. However, a cleaning blade disposed in the opposite direction can be employed as well. Furthermore, the cleaning blade is not limited to a single type, but a cleaning blade comprising a plurality of blade members can be employed as well. In this case, the present invention is applied to at least the final cleaning blade member.

What is claimed is:

1. In a method for cleaning residual toner particles remaining on the surface of a photoconductor movable cyclically in an electrophotographic copying apparatus, comprising:

bringing a cleaning blade into pressure contact with said photoconductor by actuating a solenoid connected resiliently to a lever to pivot said lever and thereby urge said blade against said photoconductor;

energizing the drive means for said photoconductor a first time period after actuation of said solenoid;

de-energizing the drive means for said photoconductor upon completion of a copying cycle;

removing said cleaning blade from contact with said photoconductor by actuation of said solenoid a second time period after de-energizing said drive means;

removing toner collected by the blade by a brush roller rotated adjacent said blade in a direction whereby its peripheral surface moves opposite the movement of said photoconductor, said cleaning blade and brush roller being mounted in a housing having a seal member riding along said photoconductor, said brush roller being rotated adjacent said seal member to clean toner therefrom.

2. A method as in claim 1, said seal member being formed of nylon threads embedded in the surface of an aluminun evaporated polyester film.

* * * * *